United States Patent [19]

Toups

[11] Patent Number: 4,759,268

[45] Date of Patent: Jul. 26, 1988

[54] DESK DRAFT GUARD

[76] Inventor: Claiborne J. Toups, P.O. Box 1310, Thibodaux, La. 70302

[21] Appl. No.: 860,044

[22] Filed: Jul. 26, 1988

[51] Int. Cl.[4] ..... A47B 97/00

[52] U.S. Cl. ..... 98/1; 312/194; 312/237

[58] Field of Search ..... 98/1; 312/194, 210, 312/237, 239

[56] References Cited

U.S. PATENT DOCUMENTS

| | | | |
|---|---|---|---|
| 1,914,757 | 6/1933 | Sams | 312/237 |
| 2,721,107 | 10/1955 | Brill | 312/237 X |
| 2,853,351 | 9/1958 | Bassett | 312/194 |
| 3,309,500 | 3/1967 | Reynolds | 219/345 |
| 3,372,964 | 3/1968 | Eversman | 312/194 |
| 4,458,961 | 7/1984 | Browning | 312/194 X |
| 4,484,787 | 11/1984 | Stephens | 312/239 |

*Primary Examiner*—Harold Joyce

[57] ABSTRACT

A desk draft guard disposed in occluding position to a horizontal opening defined between the bottom of a desk and a floor for guarding against a draft through the horizontal opening from reaching the kneehole of the desk comprising panel means disposed in occluding position to the horizontal opening for guarding against a draft as aforesaid.

8 Claims, 1 Drawing Sheet

DESK DRAFT GUARD

BACKGROUND OF THE INVENTION

1. Field of the Invention

This invention relates broadly to a desk draft guard for preventing a draft under a desk from reading the kneehole of the desk and ultimately the legs and feet of a person sitting at the desk.

2. Description of the Prior Art

The invention as visualized herein has particular application with respect to desks which are located near to and facing towards doorways to buildings. That is to say, many conventional desks as disclosed in the prior art have bottoms which are elevated relative to floors thereby defining horizontal passageways or openings through which drafts travel in response to doors being opened; these horizontal passageways or openings communicating with the desk kneeholes enabling the drafts to enter the kneeholes and reach the legs and feet of a person sitting there. Of particular consequence are drafts created by opening doors during winter months when the air is quite cold and windy; the cold air draft being very discomforting to a person sitting at the desk. Heretofore a means for overcoming this problem was simply to provide a desk having its bottom resting on the floor per se effectively obviating a passageway to isolate the kneehole as also shown in the prior art. However, it is impractical in many cases to provide such a specially designed desk just for the purpose of preventing drafts from reaching the kneehole of the desk.

SUMMARY OF THE INVENTION

It is therefore an object of this invention to provide a desk draft guard for a conventional desk which overcomes the aforesaid disadvantage of having a draft reach a person sitting at the desk.

Another object of the present invention is to provide a desk draft guard which is selectively removable from the desk.

To achieve the foregoing and other obvious objects of the invention, both stated and unstated hereinafter, the invention provides a desk draft guard disposed in occluding position to a horizontal opening defined between the bottom of a desk and a floor for guarding against a draft through the horizontal opening from reaching the kneehole of the desk comprising; panel means disposed in occluding position to the horizontal opening for guarding against a draft through the horizontal opening from reaching the kneehole of the desk as aforesaid.

Other objects of the invention more or less broad than the foregoingwill become apparent from the hereinafter following description of the elements, parts and principles of the invention given herein solely by way of example and with reference to the accompanying drawing wherein like reference numerals refer to like parts of the invention.

DESCRIPTION OF THE PREFERRED EMBODIMENT

Figures 1, 2:
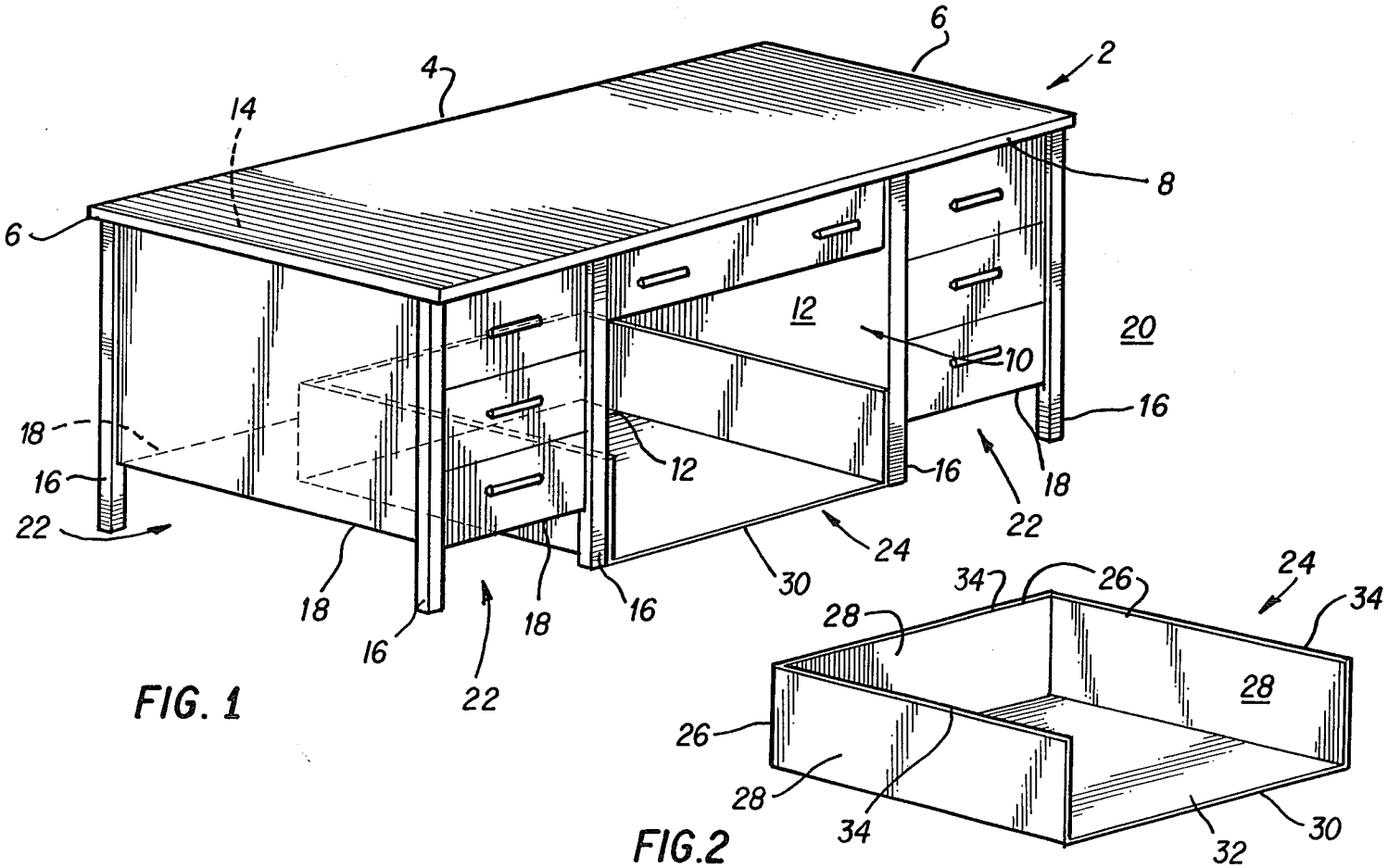
FIG. 1 is an isometric view of a conventional desk with the desk draft guard in operative position.
FIG. 2 is an isometric view of the desk draft guard according to the invention in isolation.

The preferred embodiment of the present invention is illustrated generally in FIG. 1. Therein a conventional desk 2 is shown to have a front side 4, lateral sides 6—6, backside 8 and a kneehole 10; the latter being defined between internal opposed walls 12—12 and a front wall 14. In addition, desk 2 includes a plurality of spaced legs 16 supporting the desk bottom 18 in elevated relation to floor 20 to thereby define a horizontal passageway or opening 22 communicating between the outer periphery of desk 2 and said kneehole 10 in the known manner.

FIG. 2 illustrates desk draft guard 24 according to the invention as comprising panel means 26 having three vertically disposed panels 28, each fixed to an adjacent panel 28 at a right angle; said panels 28 having a vertical height greater than the vertical height of said passageway or opening 22 for purposes which will become apparent. In addition thereto, said desk draft guard 24 includes holding means 30 for holding said panel means 26 in position. More specifically, said holding means 30 includes a horizontally disposed support member 32 fixed to said panels 28 at right angles to support them in the vertical and angular positions aforesaid. It will be understood of course that said desk draft guard 24 will be dimensioned to correspond closely with the internal length and width dimensions of said kneehole 10 enabling said desk draft guard 24 to nest freely and snugly within said kneehole 10 and on floor 20 in operative position as shown in FIG. 1. In order to forceably resist a draft it is visualized that said desk draft guard 24 will be formed of a suitably strong material such as molded plastic, for example.

In the operative position of FIG. 1 it will be understood that said desk draft guard 24 is removably disposable on said floor 20 and within said kneehole 10 whereby said panel means 26 is in occluding position to said horizontal opening 22 to thereby guard against a draft through the horizontal opening 22 from reaching said kneehole 10 and ultimately the legs and feet of a person sitting at said desk 2. More particularly, said panels 28 will be positioned within said kneehole 10 such that their upper edges 34 will terminate vertically above desk bottom 18 in close proximity to said kneehole walls to thereby completely occlude said passageway 22 about the periphery of the kneehole 10 as defined by walls 12 and 14; said panels 28 being held in fixed position by said holding means 30.

In summary, it will be appreciated that said desk draft guard 24 can be selectively disposed in nested operative position within said kneehole 10 whereby the feet of a person sitting at said desk 2 are able to rest directly on said support member 32 while at the same time being protected from a draft by said vertically disposed panels 28.

I claim:

1. A desk draft guard disposable in occluding position to a horizontal opening defined between the bottom of a desk and a floor for guarding against a draft through the horizontal opening from reaching the kneehole of the desk, wherein the kneehole is defined by three vertical walls, comprising:

rigid panel means having three interconnected vertical panels corresponding to the respective three vertical walls of the kneehole being disposable on the floor in nested relationship within the kneehole and terminating at a vertical height greater than the bottom of the desk to thereby fully occlude said horizontal opening about the periphery of the kneehole for guarding against a draft through the horizontal opening from reaching the kneehole of the desk as aforesaid.

2. A desk draft guard as defined in claim 1 and further including:

means for holding said rigid panel means in said occluding position.

3. A desk draft guard as defined in claim 2 wherein:

said holding means comprises a support member fixed to said rigid panel means in angular relation.

4. A desk draft guard as defined in claim 3 wherein:

said support member is rectangular.

5. In combination with a desk having a kneehole defined by three vertical walls and a horizontal opening defined between the bottom of said desk and a floor whereby a draft is capable of traveling through said horizontal opening and into said kneehole, a desk draft guard comprising:

rigid panel means having three interconnected vertical panels corresponding to the respective three vertical walls of said kneehole being disposable on the floor in nested relationship within said kneehole and terminating at a vertical height greater than the bottom of said desk to thereby fully occlude said horizontal opening about the periphery of said kneehole for guarding against a draft through said horizontal opening and into said kneehole.

6. The combination of claim 5 and further including:

means for holding said rigid panel means in said occluding position.

7. The combination of claim 6 wherein:

said holding means comprises a support member fixed to said rigid panel means in angular relation.

8. The combination of claim 7 wherein:

said support member is rectangular.

* * * * *